US009168733B2

(12) United States Patent
Nadachi et al.

(10) Patent No.: US 9,168,733 B2
(45) Date of Patent: Oct. 27, 2015

(54) DEVICE FOR MANAGING PRINTING SOLUTION IN PRINTING MACHINE

(71) Applicant: MITSUBISHI HEAVY INDUSTRIES PRINTING & PACKAGING MACHINERY, LTD., Mihara-shi, Hiroshima (JP)

(72) Inventors: Mitsuhiro Nadachi, Mihara (JP); Osamu Hatano, Mihara (JP)

(73) Assignee: MITSUBISHI HEAVY INDUSTRIES PRINTING & PACKAGING MACHINERY, LTD., Mihara-Shi, Hiroshima (JP)

( * ) Notice: Subject to any disclaimer, the term of this patent is extended or adjusted under 35 U.S.C. 154(b) by 0 days.

(21) Appl. No.: 14/240,580

(22) PCT Filed: Oct. 24, 2012

(86) PCT No.: PCT/JP2012/077486

§ 371 (c)(1),
(2) Date: Feb. 24, 2014

(87) PCT Pub. No.: WO2013/065548

PCT Pub. Date: May 10, 2013

(65) Prior Publication Data

US 2014/0224139 A1 Aug. 14, 2014

(30) Foreign Application Priority Data

Oct. 31, 2011 (JP) ..... 2011-239799

(51) Int. Cl.
*B41F 31/20* (2006.01)
*B41F 31/00* (2006.01)

(Continued)

(52) U.S. Cl.
CPC ..... *B41F 31/005* (2013.01); *B41F 5/24* (2013.01); *B41F 31/02* (2013.01); *B41F 31/20* (2013.01);

(Continued)

(58) Field of Classification Search
CPC ..... B41F 31/20; B41F 31/005; B41F 31/025; B41F 31/027; B41F 31/06; B41P 2231/21; B41P 2231/20
See application file for complete search history.

(56) References Cited

U.S. PATENT DOCUMENTS 3,596,672 A * 8/1971 McBee ..... 137/92
5,003,877 A * 4/1991 Yano et al. ..... 101/363

(Continued)

FOREIGN PATENT DOCUMENTS

JP H06-040015 A 2/1994
JP H06-510080 A 11/1994

(Continued)

OTHER PUBLICATIONS

PCT, "International Preliminary Report on Patentability for PCT/JP2012/077486," May 15, 2014.

*Primary Examiner* — Matthew G Marini
*Assistant Examiner* — Leo T Hinze
(74) *Attorney, Agent, or Firm* — Manabu Kanesaka

(57) ABSTRACT

In a printing machine that carries out printing while circulating a printing solution, the device inhibits foaming of the ink so that the viscosity of the ink is efficiently controlled.
In a printing machine that carries out printing while circulating the printing solution containing a resin component to be transferred to the surface to be printed and a surfactant through a circulation route (10), the device supplies a viscosity adjusting solution that controls the viscosity of the printing solution to the printing solution containing foam generated on the circulation route (10) to break the foam.

11 Claims, 5 Drawing Sheets

(51) Int. Cl.

| | |
|---|---|
| ***B41F 31/02*** | (2006.01) |
| ***B41J 2/175*** | (2006.01) |
| ***B41J 2/195*** | (2006.01) |
| ***B41F 31/28*** | (2006.01) |
| ***B41F 5/24*** | (2006.01) |

(52) U.S. Cl.
CPC ..... *B41F 31/28* (2013.01); *B41J 2/175* (2013.01); *B41J 2/17596* (2013.01); *B41J 2/195* (2013.01); *B41J 2202/12* (2013.01); *B41P 2231/20* (2013.01)

(56) References Cited

U.S. PATENT DOCUMENTS

| | | | | |
|---|---|---|---|---|
| 5,534,049 | A | 7/1996 | Wallstrom et al. | |
| 5,915,302 | A * | 6/1999 | Baba et al. | 101/366 |
| 6,251,987 | B1 | 6/2001 | Sacripante et al. | |
| 6,299,941 | B1 | 10/2001 | Sacripante et al. | |
| 6,546,866 | B1 | 4/2003 | Adachi et al. | |
| 6,901,861 | B2 | 6/2005 | Adachi et al. | |
| 2004/0194651 | A1 | 10/2004 | Adachi et al. | |
| 2009/0000499 | A1 * | 1/2009 | Boose et al. | 101/363 |
| 2011/0041714 | A1 * | 2/2011 | Boettcher | 101/335 |

FOREIGN PATENT DOCUMENTS

| | | | |
|---|---|---|---|
| JP | H09-123427 | A | 5/1997 |
| JP | 2562897 | Y2 | 2/1998 |
| JP | H11-116877 | A | 4/1999 |
| JP | 2001-343316 | A | 12/2001 |
| JP | 2006-35587 | A | 2/2006 |
| JP | 2006-205614 | A | 8/2006 |
| JP | 2007-245735 | A | 9/2007 |
| JP | 2010-047670 | A | 3/2010 |
| JP | 2011-98492 | A | 5/2011 |

* cited by examiner

DEVICE FOR MANAGING PRINTING SOLUTION IN PRINTING MACHINE

RELATED APPLICATIONS

The present application is National Phase of International Application No. PCT/JP2012/077486 filed Oct. 24, 2012, and claims priority from Japanese Application No. 2011-239799, filed Oct. 31, 2011.

TECHNICAL FIELD

The present invention relates to a device for managing printing solution in a printing machine, the device being preferably applied to management of the viscosity of a water-based flexo ink for a flexographic printing machine.

BACKGROUND

A flexographic printing machine is one type of printing machines that constantly manage ink in a proper state by circulating the ink.

A flexographic printing machine provides therein an ink fountain so as to be in contact with the surface of an ink-applying roll called an anilox roll. Ink in the ink fountain is supplied to very fine dimples or holes called cells formed on the surface of the anilox roll, is further supplied from the cells to a printing cylinder having a relief being formed of rubber or synthetic resin at its outer circumference, and is finally transferred onto a sheet to be printed.

Using flexo ink, such a flexographic printing machine circulates the flexo ink by supplying the flexo ink from an ink supply source to the ink fountain through an ink supply pipe and also reclaiming the flexo ink from the ink fountain to the ink supply source through an ink reclaiming pipe. Thereby, the flexo ink in the ink fountain is kept kinetic, so that solidification of the flexo ink is prevented and the printing process can be carried out without interruption.

Various types of flexographic printing machines are provided such as: a two-roll flexographic printing machine in which an ink fountain is formed at a space on the nip contact between an anilox roll and a doctor roll that is formed by wrapping rubber around an iron core (see Patent Literature 1); and a chamber-type flexographic printing machine that forms an ink fountain at a space called a chamber formed by an anilox roll and a doctor blade being in contact with the anilox roll.

Patent Literature 1 describes the technique that relates to a two-roll flexographic printing machine. This technique aims at rapidly washing off ink remaining in the ink fountain and ink transferring pipes and generates an adequate amount of air flow to remove ink remaining on the inner walls of the ink transferring pipes downstream from the ink fountain to the pipes. This rapidly removes remaining ink when ink color is to be changed.

Besides a flexographic printing machine, a continuous-type ink-jet printer is an exemplary of a printing machine that circulates ink during the printing process.

Patent Literature 2 describes a technique that relates to such an ink-jet printer circulating ink during the printing process. The disclosed technique is to jet ink supplied from an ink tank storing the ink through a print head towards an object to be printed and reclaims jetted ink which has not been used for printing to restore the ink into the ink tank.

This technique involves an improving solution to problems caused when the ink in the tank foams. Specifically, since such generated foam in the tank stay on the surface of the liquid-form ink, the presence of foam makes it difficult to detect an amount of ink remaining in the tank. Furthermore, when an adequate amount of liquid-form ink is stored, foam only on the surface of the liquid-form ink do not enter the main tank, but when the liquid-form ink has exhausted, the foam also flow into the main tank.

As a solution, Patent Literature 2 provides a front receiving tank disposed upstream of the ink tank in the direction of ink collection; foaming inhibiting means that lessens foaming of the ink when the ink is being collected into the front receiving tank; and a connecting pipe that connects the bottom of the front receiving tank and the bottom of the ink tank in ink collecting means that reclaims the ink, aiming at less ink foaming. The foaming inhibiting means applies a spraying mechanism that sprays collected ink toward the inner wall of the front receiving tank or the surface of the ink so that the spray of ink surely hits the foam on the surface of the liquid-form ink and thereby efficiently breaks the foam.

PRIOR ART REFERENCE

Patent Literature

[Patent Literature 1] Japanese Laid-open Patent Publication No. 2007-245735

[Patent Literature 2] Japanese Laid-open Patent Publication No. 2011-98492

SUMMARY OF INVENTION

Problems to be Solved by Invention

In accordance with recent upsurge of interest in global environmental protection, water-based flexo ink has been popularized. Such water-based flexo ink mainly contains the components of: varnish dissolving therein alkaline soluble resin, water-miscible emulsion resin, pigment, and an additive and further contains water added thereto. In most cases, the additive includes a surfactant containing a surfactant, flexo ink foams when being applied to a flexographic printing machine. Above all, flexo ink in the ink fountain easily foams because the surface of the anilox roll stirs the ink.

It is very important for proper printing in a flexographic printing machine to control the viscosity of flexo ink. Changing the viscosity of ink changes the thickness of ink to be transferred onto the printing surface, which largely affects the quality of the resultant printing.

Normally, the viscosity of flexo ink is controlled in a state of being stored in an ink can serving as an ink supplying source. If foaming ink directly returns to the ink can from the ink fountain, foaming ink is to be stored in the ink can. If the ink is vigorously foaming, ink successively flows into the ink can before the foam in the ink can break (get defoamed), which increases the foaming. This makes it difficult to correctly grasp the viscosity of the ink in the ink can, so that the viscosity of the ink is not properly controlled.

In the technique of inhibiting foaming for an ink jet printer disclosed in Patent Literature 2, that is, in the technique of breaking foam on the top surface of the liquid-form ink by spraying ink onto the foam, the change in color of the ink requires washing the spraying mechanism, which increases washing water and time to wash the mechanism. Furthermore, since there is a possibility of settling the ink in the spraying mechanism while the printing machine is stopped and clogging the spraying mechanism, the viscosity of the ink needs to be controlled more efficiently. The viscosities of solutions such as the varnish and the coating solution as well as the ink to be applied onto the printing surface need to be controlled.

With the foregoing problems in view, the object of the present invention is to provide a device to manage a printing solution for a printing machine in which, for example, carries out printing while circulating the printing solution such as ink, the device inhibiting the printing solution from foaming and more efficiently controlling the viscosity of the printing solution.

Means to Solve the Problems

To attain the above object, as a first generic feature, there is provided a device for managing a printing solution in a printing machine that carries out printing while circulating the printing solution through a circulation route, the printing solution containing a resin component to be transferred onto a surface to be printed and a surfactant, the device including: a liquid supplier that supplies the printing solution containing foam generated in the circulation route with a viscosity adjusting solution for controlling the viscosity of the printing solution to break the foam.

As a preferable feature, the circulation route may include a tank that stores therein the printing solution and that is used for controlling therein the viscosity of the printing solution, and a filter disposed at an entrance of the printing solution returning to the tank; and the liquid supplier may include a spray nozzle that sprays the viscosity adjusting solution onto the printing solution containing the foam and being reclaimed in the filter.

As another preferable feature, the filter may be installed in an auxiliary tank disposed at upper portion of the tank; and an ejector through which the printing solution dropped through the filter flows into the tank may be formed at a lower portion of the auxiliary tank.

As an additional preferable feature, the circulation route may further include: the tank; a printing solution fountain that stores therein the printing solution in the vicinity of a point of performing printing; a supply pipe that supplies the printing solution from the tank to the printing solution fountain; and a reclaiming pipe that reclaims an excess of the printing solution from the printing solution fountain to the tank.

As a further preferable feature, the tank may include an inner wall upwardly inclined to the vertical direction; the ejector of the auxiliary tank may be arranged such that the printing solution runs on the inner wall and then flows into the tank; and the auxiliary tank may have a bottom downwardly inclined towards the ejector.

As a still further preferable feature, the printing solution fountain may be segmented by outer circumferences of two adjacent rotating rolls; the device may further include two printing solution reclaiming pans being disposed at the both ends of the two rotating rolls along the axis direction of the rotating rolls; and the liquid supplier may further include spray nozzle that sprays the viscosity adjusting solution to the printing solution flowing from the printing solution fountain and temporarily stored in the respective printing solution reclaiming pans.

As a still further preferable feature, the printing solution fountain may be segmented by part of an outer circumference of a rotating roll, a blade being in contact with the rotating roll, and end seals opposing to the rotating roll; and a liquid supplier that supplies the end seals with the viscosity adjusting solution may be disposed.

As a still further preferable feature, the liquid supplier intermittently may supply the viscosity adjusting solution.

As a still further preferable feature, the printing machine may be a flexographic printing machine that uses water-based flexo ink as the printing solution and uses water as the viscosity adjusting solution; and the circulation route may include the tank configured to be an ink supply source, an ink fountain in contact with the surface of an anilox roll, an ink supply pipe that supplies the flexo ink from the tank to the ink fountain, and an ink reclaiming pipe that reclaims an excess of the flexo ink from the ink fountain to the tank.

As a second generic feature, there is provided a method for managing printing solution in a printing machine that carries out printing while circulating the printing solution through a circulation route, the printing solution containing a resin component to be transferred onto a surface to be printed and a surfactant, the method including: supplying the printing solution containing foam generated in the circulation route with a viscosity adjusting solution for controlling the viscosity of the printing solution to break the foam.

As a preferable feature, the method may further include dropping the printing solution flowing through the circulation route into a temporary reservoir; supplying the viscosity adjusting solution to the dropped printing solution to break the foam of the printing solution; and passing the printing solution through a filter.

As another preferable feature, the method may further include reclaiming the printing solution to an end (or both ends) of a space being segmented by outer circumferences of two adjacent rotating rolls on the circulation route; temporarily storing the printing solution in the end(ends) of the space; and supplying the viscosity adjusting solution to the printing solution temporarily stored in the end (ends) of the space to break the foam.

As an additional preferable feature, the method may further include supplying the viscosity adjusting solution to points being in slidable contact with end seals disposed on ends of a space that stores the printing solution on the circulation route.

As a further preferable feature, the method may further include intermittently supplying the viscosity adjusting solution.

Effects of Invention

The device and the method for managing a printing solution in a printing machine of the present invention break foam by supplying a viscosity adjusting solution to the printing solution containing foam generated in the circulation route in the printing machine, so that the foam of the printing solution decreases and also the viscosity of the printing solution can be adjusted. Foam in the printing solution hinders grasping the viscosity of the printing solution, but the present invention reduces foam to make it possible to surely grasp the viscosity. This makes it easy to control the viscosity of the printing solution. Furthermore, the viscosity control is compatible with foam breaking, which also makes it easy to control the viscosity.

Since a filter is installed in an auxiliary tank disposed at upper portion of the tank and an ejector through which the printing solution dropped through the filter flows into the tank is formed at a lower portion of the auxiliary tank, it is possible to separate foam at the upper part from the liquid at the lower part in the auxiliary tank even if the printing solution dropping through the filter still contains foam. Only the liquid from which the foam are further removed flows from the ejector disposed at the lower portion of the auxiliary tank into the tank to further reduce intrusion of foam into the tank.

Since the circulation route includes a tank that stores therein the printing solution and that is used for controlling therein the viscosity of the printing solution, and a filter disposed at an entrance of the printing solution reclaiming to the tank; and since the liquid supplier includes a spray nozzle that sprays the viscosity adjusting solution onto the printing solution containing the foam and being reclaimed in the filter, the foam in the printing solution is caught by the filter and the liquid free from the foam flows into the tank. The foam caught in the filter are broken by the viscosity adjusting solution sprayed from the spray nozzle to become liquid, which then flows into the tank. As a consequence, it is possible to inhibit the foam from flowing into the tank.

Since the tank includes an inner wall upwardly inclined to the vertical direction and the ejector of the auxiliary tank is arranged such that the printing solution runs on the inner wall and then flows into the tank, it is possible to inhibit the printing solution flowing into the tank from foaming. Since the auxiliary tank has a bottom downwardly inclined towards the ejector, it is also possible to inhibit the printing solution flowing into the tank from foaming.

Since the printing solution fountain is segmented by outer circumferences of two adjacent rotating rolls; the device further includes two printing solution reclaiming pans being disposed at the both ends of the two rotating rolls along the axis direction of the rotating rolls; and the liquid supplier further includes spray nozzles that spray the viscosity adjusting solution to the printing solution flowing from the printing solution fountain and temporarily stored in the respective printing solution reclaiming pans, the viscosity adjusting solution accomplishes both viscosity control and foam breaking also in the printing solution reclaiming pans.

Since the printing solution fountain is segmented by part of an outer circumference of a rotating roll, a blade being in contact with the rotating roll, and end seals opposing to the rotating roll; and since a liquid supplier that supplies the viscosity adjusting solution is disposed on the end seal, the viscosity adjusting solution accomplishes both viscosity control and lubrication of the end seals.

Intermittent supply of the viscosity adjusting solution by the liquid supplier makes it easy to establish both viscosity control and foam breaking, and also to establish the viscosity control and lubrication.

If the printing machine is a flexographic printing machine that uses water-based flexo ink as the printing solution and uses water as the viscosity adjusting solution, using inexpensive and easily manageable water as the viscosity adjusting solution and intermittently spraying water make it possible to efficiently break foam, preventing an excessive amount of water from being sprayed for the foam breaking.

Since the method of managing the printing solution of the present invention drops the printing solution flowing through the circulation route into a temporary reservoir; supplies the viscosity adjusting solution to the dropped printing solution to break the foam; and passes the printing solution through a filter, the foam in the printing solution can be efficiently broken.

Since the method reclaims the printing solution to an end (or both ends) of a space being segmented by outer circumferences of two adjacent rotating rolls on the circulation route; temporarily stores the printing solution in the end (ends) of the space; and supplies the viscosity adjusting solution to the printing solution temporarily stored in the end (ends) of the space to break the foam, the foam in the printing solution can also be efficiently broken.

Since the method supplies the viscosity adjusting solution to points being in slidable contact with end seals disposed on the ends of the space that stores the printing solution on the circulation route, viscosity control and lubrication can be established at the same time. In addition, also supplying the viscosity adjusting solution to the temporarily reservoir makes it possible to inhibit generation of uneven printing due to excessive supply of the viscosity adjusting solution to the end seals.

EMBODIMENT TO CARRY OUT INVENTION

Hereinafter, embodiments of the present invention will now be described with reference to the accompanying drawings.

Figure 5:
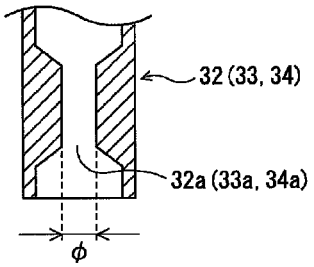
FIG. 5 is a sectional view of a spray nozzle included in an ink management device for a flexographic printing machine of the first embodiment of the present invention.
Figure 6:
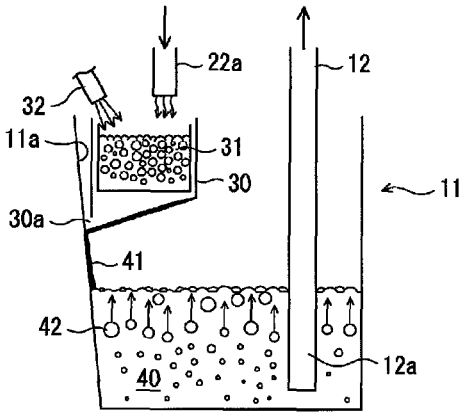
FIG. 6 is a sectional view of a tank (ink can) explaining the effects of an ink management device (an example of a device for managing a printing solution) for a flexographic printing machine of the first embodiment of the present invention.
Figure 7:
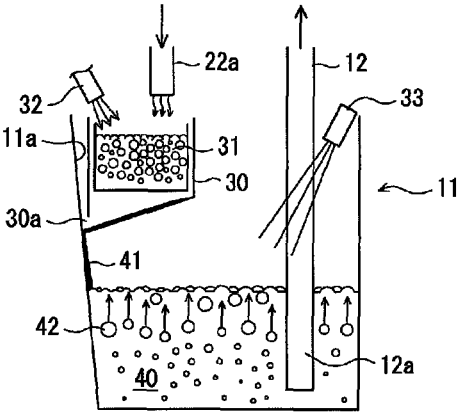
FIG. 7 is a sectional view of a tank (ink can) equipped with a spray nozzle in an ink management device for a flexographic printing machine according to a first modification to the first embodiment of the present invention.
Figure 8A:
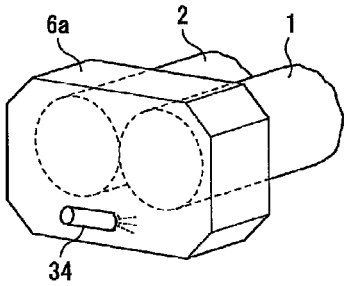
FIGS. 8A and 8B are sectional views illustrating an end portion of an ink fountain of a flexographic printing machine according to a second modification to the first embodiment of the present invention, FIG. 8A being a perspective view thereof and FIG. 8B being a sectional view thereof.
Figure 8B:
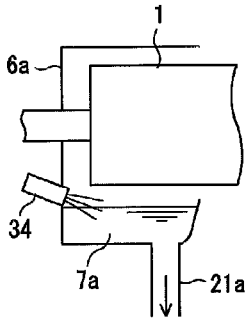
Figure 9:
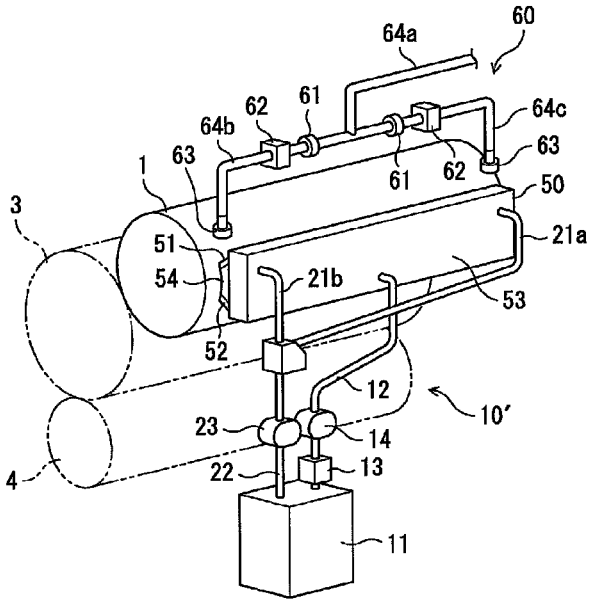
FIG. 9 is a perspective view illustrating the main part of a flexographic printing machine according to a second embodiment of the present invention.

FIGS. 1-6 are diagrams illustrating the first embodiment of the present invention; FIGS. 7 and 8 are diagrams describing modifications to the first embodiment of the present invention; and FIG. 9 is a diagram illustrating the second embodiment of the present invention. Description will now be made with reference to these drawings.

First Embodiment

The printing machine according to the first embodiment is a flexographic printing machine, which uses water-based flexo ink as a printing solution and uses water as a viscosity adjusting solution that controls the viscosity of the printing solution. The flexographic printing machine of the first embodiment assumes to be a two-roll flexographic printing machine in which an ink fountain is formed at a space on a nip contact portion between a metal anilox roll and a rubber doctor roll. Accordingly, the device for managing a printing solution of the present invention can be referred to as an ink management device for a flexographic printing machine.

Figure 2:
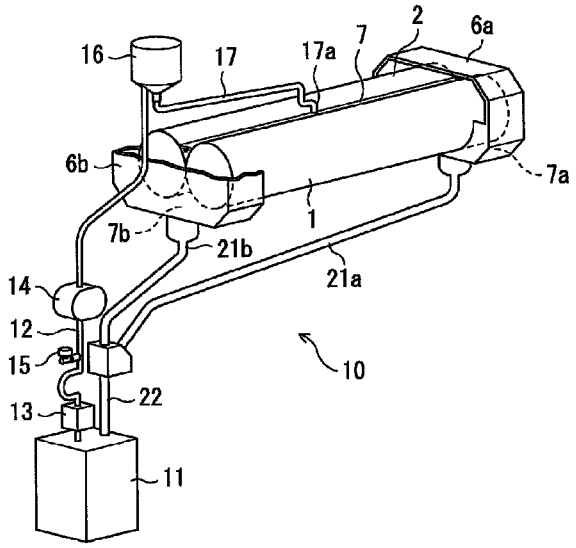
FIG. 2 is a perspective view of the main part of a flexographic printing machine of the first embodiment of the present invention.
Figure 3B:
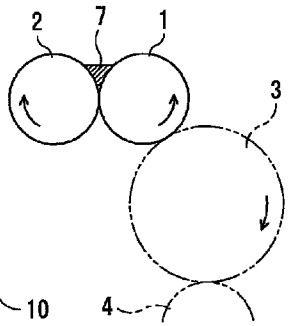
FIGS. 3A and 3B are diagrams illustrating the main part of a flexographic printing machine of the first embodiment of the present invention, FIG. 3A being a front view of the main part and FIG. 3B being a partial side view of the main part.
Figure 3A:
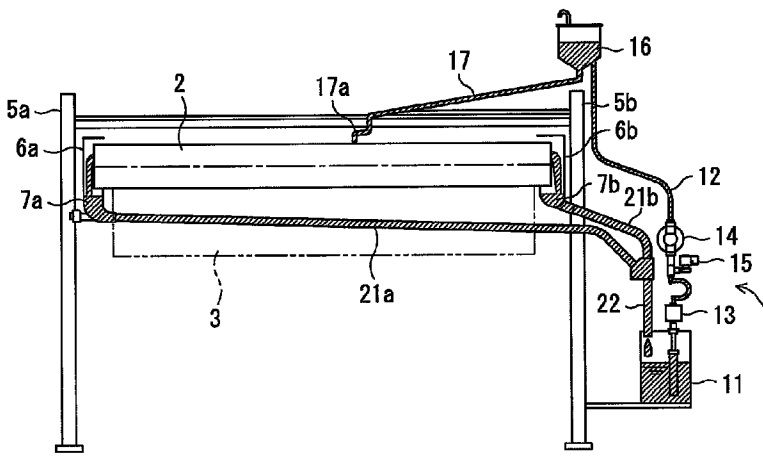

As illustrated in FIGS. 2 and 3, the flexographic printing machine of the first embodiment forms a space used as an ink fountain 7 on a nip contact portion at which a metal anilox roll 1 and a doctor roll 2 formed by wrapping rubber around an iron core are in a nip-contact. On the surface of the anilox roll 1, very fine dimples or holes called cells are formed, so that the ink in the ink fountain 7 are supplied to the cells of the anilox roll 1.

The anilox roll 1 is pressed by a printing cylinder 3 having a relief being formed of rubber or synthetic resin at its outer circumference and the ink in the cells of the anilox roll 1 is supplied to the relief on the printing cylinder 3. An impression cylinder 4 is arranged opposite to the printing cylinder 3. The printing is performed by transferring ink supplied to the relief of the printing cylinder 3 onto a sheet that is to be printed and that is running between the printing cylinder 3 and the impression cylinder 4.

The rotary axes of the rolls 1-4 are rotatably supported by frames 5*a* and 5*b* disposed on the right and left ends (i.e., the driving end and the operating end of the cross direction of the machine), but illustration of a detailed configuration is omitted here.

The water-based flexo ink (sometimes simply referred to as "ink") mainly contains varnish dissolving therein alkaline soluble resin, water-miscible emulsion resin, pigment, and an additive and further contains water added thereto. The additive includes a surfactant to disperse the pigment.

The flexography printing machine circulates the flexo ink to keep the flexo ink in the ink fountain 7 kinetic, so that solidification of the flexo ink is prevented and the printing process can be carried out without interruption.

For this purpose, an ink circulation route 10 is configured so as to include the ink fountain 7.

The ink circulation route 10 is divided into two parts of: a supply route from an ink can 11, being in the form of a tank to serve as an ink supply source, to the ink fountain 7; and a reclaiming route from the ink fountain 7 to the ink can 11.

The supplying route is formed of an ink supply pipe 12 installed from the ink can 11 to the ink fountain 7 disposed above the ink can 11; a filter 13, a cock 15, and a pump 14 that are disposed at the middle of the ink supply pipe 12 in sequence from the upstream side; a supply tank 16 disposed at the downstream end (i.e., disposed at the upper end) of the ink supply pipe 12 to temporarily store the ink and thereby adjust the supplying pressure of the ink; and an ink supply pipe 17 installed from the supply tank 16 to a position immediately over the ink fountain 7.

The ink contained in the ink can 11 is sucked from the upstream end (disposed at lower end) 12*a* of the ink supply pipe 12 extending near to the bottom of the ink can 11 by the pump 14, and impurities such as dust in the ink are removed by the filter 13. Then the ink is sent to the supply tank 16. The supplying pressure of the ink in the supply tank 16 is controlled by adjusting the height of the ink therein and the ink is supplied to the ink fountain 7 disposed below the supply tank 16 through the ink supply pipe 17. The downstream end 17*a* of the ink supply pipe 17 is disposed substantially at a center position in the axis direction of the ink fountain 7 and ink is substantially uniformly supplied along the axis direction of the ink fountain 7.

The reclaiming route is formed by temporary reservoirs 7*a* and 7*b* that are formed at bottoms of ink pans 6*a* and 6*b* serving as printing solution reclaiming pans disposed at the both ends of the nip portion between the anilox roll 1 and the doctor roll 2 where the ink fountain 7 is formed, and that receives ink flowing out of the ink fountain 7; ink reclaiming pipes 21*a* and 21*b* installed from the temporary reservoirs 7*a* and 7*b* toward the ink can 11 disposed below; and an ink reclaiming pipe 22 being installed downstream of the confluence of the ink reclaiming pipes 21*a* and 21*b* and having the downstream end 22*a* on the ink can 11.

The viscosity (also considered as concentration) of the ink collected in the ink can 11 is controlled, so that the ink always having a prefixed viscosity is transferred from the ink can 11 to the ink fountain 7 through the supplying route and then is supplied to the inside of the cells of the anilox roll 1 from the ink fountain 7. Most of the ink is not supplied to the inside of the cells and is collected in the ink can 11 through the reclaiming route as excess ink.

Since the ink contains a surfactant and the anilox roll 1 and the doctor roll 2 are rotating in the ink fountain 7 to stir the ink in the ink fountain 7, the ink foams by the action of the surfactant. In addition to the above, the ink tends to easily foam by the action of the surfactant at the point where the ink flows into the ink fountain 7 from the downstream end 17*a* of the ink supply pipe 17, the points where the ink flows into the temporarily reservoirs 7*a* and 7*b* from the ink fountain 7, and the point where the ink flows into the ink can 11 at the downstream end 22*a* of the ink reclaiming pipe 22.

Figure 1:
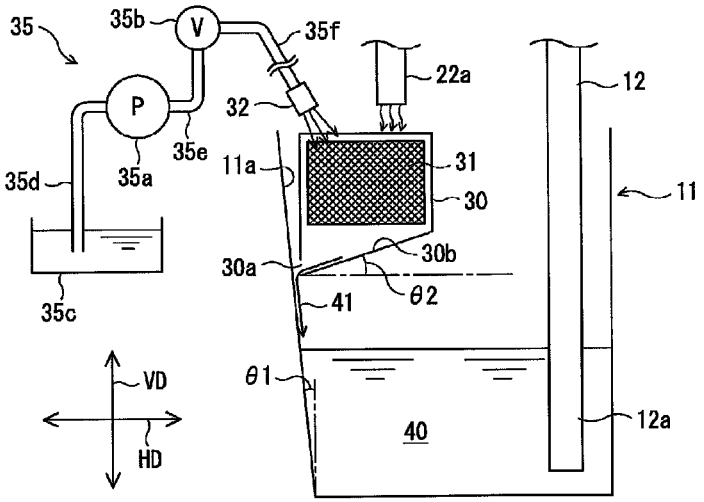
FIG. 1 is a sectional view illustrating a tank (ink can) serving as the main part of an ink management device (an example of a device for managing printing solution) for a flexographic printing machine according to a first embodiment of the present invention.

As illustrated in FIG. 1, in order to remove the foam of the ink and properly control the ink, there are disposed, immediately under the downstream end 22*a* of the ink reclaiming pipe 22 in the ink can 11, an auxiliary tank 30 disposed at the upper portion of the ink can 11, and a filter 31 accommodated in the auxiliary tank 30, a spray nozzle 32 that sprays water, serving as a viscosity adjusting solution, towards the inside of the filter 31 to break foam in the filter 31.

In the illustrated example, the ink can 11 is made of resin and takes the form of a substantial rectangular parallelepiped, but the material and the shape are not limited to these. The ink can 11 has an inner wall face 11*a* upwardly inclined to the vertical direction. The inner wall face 11*a* of the first embodiment applies an inclined flat plane or otherwise may be a curved plane as far as the face 11*a* is upwardly inclined to the vertical direction. The auxiliary tank 30 is disposed over the inclined inner wall face 11*a*. In FIG. 1, the arrow HD represents the horizontal direction and the arrow VD represents the vertical direction. As illustrated in FIG. 1, the inner wall face 11*a* is inclined to the vertical direction at angle θ1 so as to point slightly upward.

Figure 4:
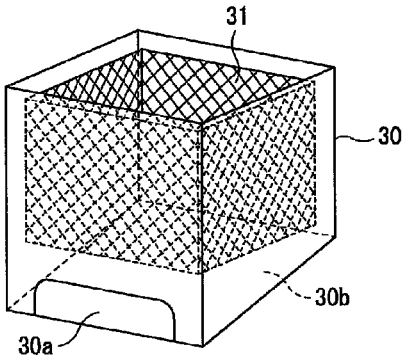
FIG. 4 is a perspective view illustrating an auxiliary tank and a filter included in an ink management device for a flexographic printing machine of the first embodiment of the present invention.

As illustrated in FIG. 4, the auxiliary tank 30 is made of stainless steel (Steel Use Stainless: SUS) and takes the form of a substantial rectangular parallelepiped, but the material and the shape are not limited to these. An ejector 30*a* is disposed beneath the auxiliary tank 30 and the bottom 30*b* of the auxiliary tank 30 is downwardly inclined towards the ejector 30*a*. This means that the ejector 30*a* is disposed at the lowest point of the bottom 30*b* of the auxiliary tank 30. Specifically, as illustrated in FIG. 1, the face (bottom face) of the bottom 30*b* is downwardly inclined to the horizontal plane at an angle θ2 toward the ejector 30*a*.

As illustrated in FIG. 1, the auxiliary tank 30 has the ejector 30*a* that points to the inner wall face 11*a* of the ink can 11 and that is in the vicinity of the inner wall face 11*a*. With this configuration, the ink in the auxiliary tank 30 flows out of the bottom 30*b* through the ejector 30*a*, runs on the inner wall face 11*a*, and finally flows into the ink can 11.

The filter 31 is made of stainless-steel mesh and takes the form of a rectangular parallelepiped having an opening at the top thereof. Although the material and the shape of the filter 31 are not limited to these, the filter 31 is preferably formed on a mesh satisfying a prescribed standard so that ink containing foam flows into the filter 31 and the foam are retained in the mesh. After the foam squash or become minute foam to liquefy, the ink liquid flows down the mesh. In this example, a mesh formed of a stainless steel line having a diameter of 0.25 mm and a density of 70 meshes (70 lines per inch) is applied to the filter 31. An excessively coarse mesh allows foam to pass through the mesh and drop into the auxiliary tank 30 while an excessively fine mesh has difficulty in dropping the foam even when the foam come to be minute through the mesh into the auxiliary tank 30, which has a possibility that the foam overflow from the auxiliary tank 30.

The spray nozzle 32 is an element of a liquid supplier 35 that supplies water serving as the viscosity adjusting solution to the ink serving as the printing solution to break the foam. The liquid supplier 35 includes a pump 35*a* that sucks water in a water tank 35*c* and pressurizes the sucked water to a predetermined pressure; an electromagnetic valve 35*b* that supplies the water from the pump 35*a* to the spray nozzle 32; and supplying pipes 35*d* to 35*f* respectively installed between the water tank 35*c* and the pump 35*a*, between the pump 35*a* and the electromagnetic valve 35*b*, and between the electromagnetic valve 35*b* and the spray nozzle 32.

As depicted in FIG. 5, the spray nozzle 32 has a spraying aperture 32*a* having a narrowed diameter. The spraying aperture 32*a* is set to have a minute inner diameter ϕ in the order of nano meter (nm). For example, a preferable spray nozzle 32 has an amount of spray of about 0.50 litter/min, and a largeness of a spray of about 270 nm. This structure causes the spray nozzle 32 to spray finely pulverized water. As illustrated in FIG. 1, the spray nozzle 32 is arranged so as to spray water toward the top surface of the foamy ink in the filter 31.

The water pressurized by the pump 35*a* to a prescribed pressure (e.g., about 0.2 MP) is conveyed to the spray nozzle 32 at timing controlled by the electromagnetic valve 35*b*. In the first embodiment, the spray nozzle 32 intermittently sprays water for a predetermined time at predetermined intervals. This is because the foam of ink are satisfactorily broken by instant spray of water while since the sprayed water is a viscosity adjusting water serving as a supplement to evaporated water, an excessive amount of sprayed water exceeds a preferable water content in the ink so that the viscosity is not preferably adjusted or managed.

For the above, the spray nozzle 32 intermittently sprays water to break ink foam without spraying excessive amount of water. The first embodiment assumes that the spray nozzle 32 spays water in an amount of 20-40 cc once in every five minutes. Since the optimum timing and amount of the spraying differ with the properties of ink, the above values are mere examples but are preferable for a normal flexo ink. The above function of the electromagnetic valve 35*b* can be controlled by an electronic device or a control circuit such as a timer relay.

With the above configuration of the ink management device (a device for managing a printing solution in a printing machine) of a flexographic printing machine according to the first embodiment, when the ink containing foam and circulating in the ink circulation route 10 flows into the ink can 11 from the downstream end 22*a* of the ink reclaiming pipe 22 through the reclaiming route, the ink firstly flows into the filter 31 in the auxiliary tank 30 disposed in the upper portion of the ink can 11. Containing foam, the ink flowing into the filter 31 vertically separates the foam at the upper portion of the filter 31 and the liquid-form component at the lower portion of the filter 31, and the liquid-form component drops onto the bottom 30*b* of the auxiliary tank 30 and flows out of the bottom 30*b* through the ejector 30*a*. At that time, the ink in the liquid form is running on the inner wall face 11*a* and flows into the ink can 11 as the reference number 41 in FIGS. 1 and 6 shows.

Ink running on the inner wall face 11*a* and flowing into the ink can 11 foams less than ink dropping directly onto the surface of the ink 40 in the ink can 11.

On the other hand, the foam are caught in the upper portion of the filter 31 but are broken into the liquid form by pulverized water intermittently sprayed from the spray nozzle 32 thereto, and then the liquefied ink drops onto the bottom 30*b* of the auxiliary tank 30. After that, the ink flows out of the ejector 30*a* and runs on the inner wall face 11*a* to flow into the ink can 11 in the same manner as the above.

In the breaking foam, larger foam break faster and smaller foam take time to break. However, the very fine foam pass through the filter 31, drop onto the bottom 30*b* of the auxiliary tank 30, and runs on the inner wall face 11*a* through the ejector 30*a* together with the liquid-form ink to finally flow into the ink can 11.

Accordingly, overflow of foam from the filter 31 can be avoided. Very fine foam having flown into the ink can 11 bind to one another to form larger foam, which rise up to the surface of the ink 40 in the ink can 11 and vanish on the surface.

In sampling the ink 40 in the ink can 11 and measuring the viscosity of the ink 40 using a Zahn cup, foam in the ink 40 hinders the correct measurement. However, according to the first embodiment, foam in the ink 40 stored in the ink can 11 are broken, the viscosity of the ink can be correctly measured, so that the viscosity of the ink can be properly controlled.

Moreover, since the foam breaking in the ink 40 is performed with water, which is also used as the viscosity adjusting solution for adjusting the viscosity of the ink, the foam breaking can be carried out concurrently with the viscosity adjustment, which facilitates efficient viscosity management of the ink.

An excessive amount of water to adjust the viscosity of the ink 40 hinders correct adjustment of the viscosity. However, since the spray nozzle 32 intermittently sprays water, the above disadvantage can be avoided.

If enduring reducing the foam breaking capability in some extent, the first embodiment can omit auxiliary tank 30, or the auxiliary tank 30 and the filter 31.

Alternatively, as illustrated in FIG. 7, in addition to or in replacement of the spray nozzle 32, another spray nozzle 33 may be disposed in such a position that the water for the viscosity adjusting solution from the spray nozzle 33 directly drops onto the top surface of the ink 40 in the ink can 11.

Furthermore, as illustrated in FIG. 8, in addition to or in replacement of the spray nozzle 32, other spray nozzles 34 may be disposed in such a position that the water for the viscosity adjusting solution from the spray nozzles 34 directly drop onto the top surface of the ink in the respective temporary reservoirs 7*a* and 7*b*.

The spray nozzles 32, 33, and 34 may be used in combination.

Second Embodiment

The printing machine according to a second embodiment is also a flexographic printing machine, uses water-based flexo ink as a printing solution and uses water as a viscosity adjusting solution that controls the viscosity of the printing solution.

FIG. 9 illustrates the second embodiment. Like reference numbers between FIG. 9 and FIGS. 2 and 3 designate similar parts and elements, so repetitious description is omitted here.

As illustrated in FIG. 9, the second embodiment assumes a chamber-type flexographic printing machine which has an ink fountain at the space defined by the anilox roll 1, a seal blade 51 in slidable contact with the anilox roll 1, a doctor blade 52, a chamber body 53, and end seals 54. Accordingly, the second embodiment differs from the first embodiment in the configuration of the ink circulation route 10' at a position close to a chamber 50 and a suction pump 23 installed in the ink reclaiming pipe 22.

Also in the second embodiment, as in the first embodiment, the spray nozzle 32 is disposed over the filter 31 incorporated in the auxiliary tank 30 disposed in the upper portion of the ink can 11 and sprays water serving as the viscosity adjusting solution for viscosity adjustment of an ink and foam breaking. In addition to the above, since the rotation of the anilox roll 1 abrades the surfaces of the end seals 54 at the points where the anilox roll 1 comes into contact with the end seals 54 in the second embodiment, water serving as the viscosity adjusting solution is supplied also onto the end seals 54 to lubricate the contacts between the anilox roll 1 and the respective end seals 54.

For this purpose, as shown in FIG. 9, supplying inlets 63 that supply water to the respective end seals 54 are formed above the end seals 54. The supplying inlets 63 are elements of the liquid supplier 60 that supplies water serving as the viscosity adjusting solution in order to prevent the surfaces of the end seals 54 being in contact with the anilox roll 1 from being abraded by the rotation of the anilox roll 1. The liquid supplier 60 includes a non-illustrated pump that sucks water in a non-illustrated tank and conveys the sucked water, electromagnetic valves 61, flow adjusting valves 62, supply pipes 64*a* through 64*d*, and supplying inlets 63.

Water conveyed through the supply pipe 64*a* by the pump is further conveyed to the supply inlets 63 from the supply pipes 64*b* and 64*c* by undergoing the open-close control by the electromagnetic valve 61 and the flow amount control by flow adjusting valve 62 at the downstream of the electromagnetic valve 61. In the second embodiment, water is intermittently supplied from the supply inlets 63 for a predetermined time in a predetermined cycle. This is because lubrication between the anilox roll 1 and the end seals 54 is satisfactorily maintained by intermittent water supply and excessive water supply causes the water content in the ink to be excessive to hinder the viscosity management, that is, viscosity control. To maintain lubrication of the end seals 54 without excessive water supply, the water is intermittently supplied to the end seals 54 from the respective supply inlets 63.

The above configuration efficiently achieves viscosity control, foam breaking, and inhabitation of abrasion of the contacting surfaces of the end seals 54 using water as the viscosity adjusting solution.

If water used as the viscosity adjusting solution is supplied from the same supplying unit 60 or 35 in order to inhibit abrasion of the surfaces of the end seals 54 being in contact with the anilox roll 1, the viscosity of the ink at the both ends of the anilox roll 1 comes to be excessively low, which may result in thinner printing at the portion of the ends of the anilox roll 1 than the remaining part. In contrast, the configuration of the second embodiment causes water serving as the viscosity adjusting solution to control the viscosity and break foam in the ink can 11 and also to control the viscosity and inhibit abrasion of the end seals at the end seals 54. In other words, the viscosity adjusting solution can be efficiently used for improvement in printing quality and in durability of the end seals.

Others:

The embodiments of the present invention are described as above. The present invention should by no means be limited to the foregoing embodiments, and various changes, modifications, and combinations of the embodiments can be suggested without departing the gist of the present invention.

In the foregoing embodiments, water is used as the viscosity adjusting solution, which may alternatively be ink diluted with water. In this case, a relatively large amount of a viscosity adjusting solution can be used in foam breaking.

However, the viscosity adjusting solution is not limited to water or ink diluted with water.

Furthermore, the printing solution containing resin to be transferred to a printing surface and a surfactant is not limited to flexo ink but may alternatively be, for example, varnish or a coating solution.

The printing machine to which the present invention is applied should by no means limited to the flexographic printing machine and may alternatively be any printing machine as far as the printing machine carries out printing while circulating the printing solution containing resin to be transferred to a printing surface and a surfactant in a circulation route.

EXPLANATION OF REFERENCE NUMBERS

1 anilox roll
2 doctor roll
3 printing cylinder
4 impression cylinder
5*a*,5*b* frame
6*a*,6*b* ink reclaiming pan serving as printing solution reclaiming pan
7*a*,7*b* temporary reservoir
7 ink fountain
10,10' ink circulation route
11 ink can serving as a tank
12 ink supply pipe
13 filter
14 pump
15 cock
16 supply tank
17 ink supply pipe
21*a*,21*b*,22 ink reclaiming pipe
30 auxiliary tank
31 filter
32,33,34 spray nozzle
35,60 liquid supplier
35*c* water tank
35*a* pump
35*b*,61 electromagnetic valve
35*d* to 35*f*,64*a* to 64*c* supply pipe
50 chamber
51 seal blade
52 doctor blade
53 chamber body
54 end seal
63 supplying inlet
62 flow adjusting valve

What is claimed is:

1. A device for managing a printing solution in a printing machine that carries out printing while circulating the printing solution through a circulation route, the printing solution containing a resin component to be transferred onto a surface to be printed and a surfactant, the device comprising:

a liquid supplier that supplies the printing solution containing foam generated in the circulation route with a viscosity adjusting solution for controlling the viscosity of the printing solution to break the foam, wherein the circulation route comprises a tank that stores therein the printing solution and that is used for controlling therein the viscosity of the printing solution, and a filter disposed at an entrance of the printing solution reclaiming to the tank, the filter being configured to catch the foam contained in the printing solution that flows into the filter, and being configured to drop liquid-form components of the printing solution, the liquid supplier comprises a spray nozzle that sprays the viscosity adjusting solution onto the foam caught in the filter, the filter is installed in an auxiliary tank disposed at an upper portion of the tank, and the auxiliary tank includes an ejector formed at a lower portion thereof, and through which the printing solution dropped through the filter flows into the tank.

2. The device according to claim 1, wherein the circulation route further comprises:

a printing solution fountain that stores therein the printing solution in the vicinity of a point of performing printing;

a supply pipe that supplies the printing solution from the tank to the printing solution fountain; and a reclaiming pipe that reclaims an excess of the printing solution from the printing solution fountain to the tank.

3. The device according to claim 2, wherein:

the printing solution fountain is segmented by outer circumferences of two adjacent rotating rolls;

the device further comprises two printing solution reclaiming pans being disposed at the both ends of the two rotating rolls along the axis direction of the rotating rolls; and the liquid supplier further comprises spray nozzle that sprays the viscosity adjusting solution to the printing solution flowing from the printing solution fountain and temporarily stored in the respective printing solution reclaiming pans.

4. The device according to claim 2, wherein:

the printing solution fountain is segmented by part of an outer circumference of a rotating roll, a blade being in contact with the rotating roll, and end seals opposing to the rotating roll; and a liquid supplier that supplies the end seals with the viscosity adjusting solution is disposed.

5. The device according to claim 1, wherein:

the tank includes an inner wall upwardly inclined to the vertical direction;

the ejector of the auxiliary tank is arranged such that the printing solution runs on the inner wall and then flows into the tank; and the auxiliary tank has a bottom downwardly inclined towards the ejector.

6. The device according to claim 5, wherein the ejector points to the inner wall and is in a vicinity of the inner wall so that the printing solution flows out of the bottom through the ejector, runs on the inner wall, and flows into the tank.

7. The device according to claim 1, wherein the liquid supplier intermittently supplies the viscosity adjusting solution.

8. The device according to claim 1, wherein the printing machine is a flexographic printing machine that uses water-based flexo ink as the printing solution and uses water as the viscosity adjusting solution; and the circulation route comprises the tank configured to be an ink supply source, an ink fountain in contact with the surface of an anilox roll, an ink supply pipe that supplies the flexo ink from the tank to the ink fountain, and an ink reclaiming pipe that reclaims an excess of the flexo ink from the ink fountain to the tank.

9. A method for managing printing solution in a printing machine that carries out printing while circulating the printing solution through a circulation route, the printing solution containing a resin component to be transferred onto a surface to be printed and a surfactant, the method comprising:

supplying the printing solution containing foam generated in the circulation route with a viscosity adjusting solution for controlling the viscosity of the printing solution to break the foam;

dropping the printing solution flowing through the circulation route into a temporary reservoir; and passing the printing solution through a filter catching the foam contained in the printing solution that flows into the filter, the filter dropping liquid-form components of the printing solution, wherein the viscosity adjusting solution is sprayed to the foam caught in the filter to break the foam.

10. The method according to claim 9, further comprising:

reclaiming the printing solution to an end (or both ends) of a space being segmented by outer circumferences of two adjacent rotating rolls on the circulation route;

temporarily storing the printing solution in the end (ends) of the space; and supplying the viscosity adjusting solution to the printing solution temporarily stored in the end (ends) of the space to break the foam.

11. The method according to claim 9, further comprising supplying the viscosity adjusting solution to points being in slidable contact with end seals disposed on ends of a space that stores the printing solution on the circulation route.

* * * * *